US007158750B2

(12) United States Patent
Iwakura et al.

(10) Patent No.: US 7,158,750 B2
(45) Date of Patent: Jan. 2, 2007

(54) PAPER TRANSPORT APPARATUS AND PAPER TRANSPORT METHOD

(75) Inventors: Yoshie Iwakura, Higashiosaka (JP); Minoru Tomiyori, Soraku-gun (JP); Susumu Murakami, Soraku-gun (JP); Hideshi Izumi, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/728,710

(22) Filed: Dec. 4, 2003

(65) Prior Publication Data

US 2004/0114978 A1 Jun. 17, 2004

(30) Foreign Application Priority Data

Dec. 6, 2002 (JP) ..... 2002-355506

(51) Int. Cl.
*G03G 15/00* (2006.01)
*G03G 15/16* (2006.01)
*B05C 1/08* (2006.01)

(52) U.S. Cl. ..... 399/388; 399/297; 399/312; 399/393; 492/18; 492/25; 492/53

(58) Field of Classification Search ..... 399/388, 399/297, 312, 393; 492/18, 25, 53
See application file for complete search history.

(56) References Cited

U.S. PATENT DOCUMENTS 3,816,839 A * 6/1974 Honda et al. ..... 347/160
4,419,003 A * 12/1983 Fujie et al. ..... 399/322
5,309,206 A * 5/1994 Deishi et al. ..... 399/280
5,862,447 A * 1/1999 Matsumura ..... 399/388
6,175,716 B1 * 1/2001 Toyama et al. ..... 399/384
6,308,040 B1 * 10/2001 Mizuno ..... 399/388
6,438,351 B1 * 8/2002 Kawachi et al. ..... 399/394
6,493,523 B1 * 12/2002 Weaver ..... 399/45
6,577,843 B1 * 6/2003 Akita et al. ..... 399/396
6,629,795 B1 * 10/2003 Kinoshita et al. ..... 400/582
6,708,018 B1 * 3/2004 Sato et al. ..... 399/396
2002/0176725 A1 * 11/2002 Sato et al. ..... 399/388
2003/0044217 A1 * 3/2003 Matsuda et al. ..... 400/579

FOREIGN PATENT DOCUMENTS

JP 58-065453 4/1983
JP 02244177 A * 9/1990
JP 6-214470 8/1994
JP 07257778 A * 10/1995

(Continued)

*Primary Examiner*—Daniel J. Colilla
(74) *Attorney, Agent, or Firm*—David G. Conlin; David A. Tucker; Edwards Angell Palmer & Dodge LLP

(57) ABSTRACT

Provided are photosensitive body or bodies 31*b* carrying toner; transfer roller(s) 31*d*, rotating and coming in contact with photosensitive body or bodies 31*b*, for causing toner image(s) formed on photosensitive body or bodies 31*b* to be electrostatically relocated onto paper 5; and paper transport means disposed upstream in transport direction(s) from transfer roller(s) 31*d* and comprising drive roller(s) 36*d*1 and idler roller(s) 36*d*2 holding lead edge portion(s) 5*a* of paper 5 in nip(s) formed therebetween and rotating so as to cause transport of same; drive roller(s) 36*d*1 and idler roller(s) 36*d*2 being disposed to the side, on which photosensitive body or bodies 31*b* is or are present, of a plane L more or less tangent to nip(s) formed between photosensitive body or bodies 31*b* and transfer roller(s) 31*d*; and direction(s) R of transport of paper from drive roller(s) 36*d*1 and idler roller(s) 36*d*2 being disposed so as to be directed toward transfer roller(s) 31*d*.

24 Claims, 8 Drawing Sheets

FOREIGN PATENT DOCUMENTS

| | | | |
|---|---|---|---|
| JP | 07319308 A | * | 12/1995 |
| JP | 8-062916 | | 3/1996 |
| JP | 08171295 A | * | 7/1996 |
| JP | 08185063 A | * | 7/1996 |
| JP | 11309897 A | * | 11/1999 |

* cited by examiner

PAPER TRANSPORT APPARATUS AND PAPER TRANSPORT METHOD

BACKGROUND OF INVENTION

1. Technical Field

The present invention relates to paper transport in image forming apparatuses.

2. Conventional Art

In the paper feed mechanism of an image forming apparatus, locations of drive roller and idler roller serving as paper transport means are fixed, and the direction of transport of paper fed therethrough is constant.

FIG. 7 shows the structure of a paper feed mechanism in a conventional image forming apparatus.

A conventional paper feed mechanism comprises photosensitive body 81 serving as image carrier carrying toner; transfer roller 82, rotating and coming in contact with photosensitive body 81, for causing a toner image formed on this photosensitive body 81 to be electrostatically relocated onto paper 91; and paper transport unit 83 disposed upstream in the transport direction from transfer roller 82 and comprising drive roller (PS roller) 83*a* and idler roller (PS roller) 83*b* holding paper 91 in a nip formed therebetween and rotating so as to cause transport of same; this paper transport unit 83 being disposed to the side, on which transfer roller 82 is present, of a plane L more or less tangent to the nip formed between photosensitive body 81 and transfer roller 82 (i.e., disposed below tangent plane L in FIG. 7); and direction R of transport of paper from paper transport unit 83 being set so as to be directed toward the outside circumferential surface 81*a* of the photosensitive body at a point somewhat to the near side of the nip A formed between photosensitive body 81 and transfer roller 82 (see, e.g., Japanese Patent Application Publication Kokai No. S58-65453 (1983)).

In accordance with such constitution, paper 91, upon being transported from a supply paper storage unit, not shown, is paused as lead edge portion 91*a* of paper 91 is held in the nip between drive roller 83*a* and idler roller 83*b*, paper feed thereafter being carried out with such timing as to cause lead edge 91*b* of paper 91 to be aligned with the lead edge of the toner image formed on photosensitive body 81; and at this time, in order to cause lead edge 91*b* of paper 91 to be definitively transported to the transfer unit and made to undergo the transfer operation, transport occurs, as has been stated, such that paper transport direction R is directed toward the outside circumferential surface 81*a* of the photosensitive body at a point immediately in front of transfer roller 82.

Now it so happens that in recent years there has been increasing diversity in the number of types of paper employed in image forming apparatuses and an increase in the frequency with which card stock and other such heavy-weight paper not employed heretofore has come to be used therein. There are, for example, heavy-weight papers such as card stock which have coated surface(s) and which are used as cover material in bookbinding; such papers are 250 g/m$^2$, which is well over conventional specifications for paper transport (roughly 60 g/m$^2$ to 128 g/m$^2$). Under such circumstances of diverse paper types, if paper transport unit 83 comprising drive roller 83*a* and idler roller 83*b* disposed immediately in front of photosensitive body 81 is configured in the foregoing arrangement, movement of the paper at the point of contact will vary depending upon paper rigidity (stiffness) and transport speed of the transported paper. FIG. 8(*a*) and (*b*) show the situation at such time.

To wit, as shown in FIG. 8(*a*), during transport of light-weight paper, stiffness of paper 91 is low, paper 91 being drawn in and transported in smooth fashion as a result of the surface potential of photosensitive body 81 and rotation of photosensitive body 81; but as shown in FIG. 8(*b*), in the case of heavy-weight paper, stiffness of paper 91 is high, and a phenomenon occurs whereby paper 91 bounces off therefrom before it can be drawn thereinto.

Moreover, in order to cause paper 91, as it leaves paper transport unit 83, to be accurately transported to the nip between photosensitive body 81 and transfer roller 82, a constitution employing paper transport guide plate(s) has been proposed (see, e.g., Japanese Patent Application Publication Kokai No. S58-65453 (1983) and Japanese Patent Application Publication Kokai No. H08-62916 (1996)).

Under such circumstances of diverse paper types, there has been the problem that, if paper transport unit 83 comprising drive roller 83*a* and idler roller 83*b* disposed immediately in front of photosensitive body 81 is configured in the foregoing arrangement, a phenomenon has occurred in the case of heavy-weight paper whereby the paper is bounced off therefrom before it can be drawn thereinto, resulting in poor nip entry.

Furthermore, as paper 91 is transported from paper transport unit 83, when the lead edge 91*b* thereof comes in contact with rotating photosensitive body 81, the lead edge (end region) 91*b* of the paper hits the photosensitive body surface due to the force of transport and may scratch the photosensitive body surface. In addition, there has also been the problem that as such impact of the photosensitive body surface is repeated, the surface coating layer of the photosensitive body surface is destroyed, causing leakage to occur during the operation in which photosensitive body 81 is charged, resulting in destruction of photosensitive body 81.

Furthermore, with respect to print quality, if the photosensitive body surface layer and/or photosensitive layer is directly scratched by the lead edge of the paper, surface potential at the time of the charging operation will be different there than at other locations (in most cases, resulting in a phenomenon whereby surface potential is decreased thereat), and print quality will suffer due to presence of black lines and/or white lines. Moreover, there has also been the problem that when heavy-weight paper hits photosensitive body 81, this causes drive nonuniformity in the rotation of photosensitive body 81 itself as a result of vibration, and this phenomenon causes occurrence of nonuniformity during writing of image information, resulting in occurrence of band-like nonuniformity in density (banding phenomena) at photosensitive body 81.

In cases such as these, an increase in film thickness at photosensitive body 81 might be considered as one strategy with respect thereto, but this would result in the problem that an increase in film thickness tends to decrease the photosensitivity of photosensitive body 81, and tends to decrease print quality. Furthermore, were film thickness to be increased it would be necessary to apply a voltage greater than that which would otherwise be necessary in order to maintain surface potential at photosensitive body 81; and, particularly in recent years, with the trend toward higher resolutions, when improvement in sensitivity of photosensitive body 81 is being sought, there are many situations where a method involving maintenance of a high surface potential would not be adopted.

Furthermore, the method of installing paper transport guide plate(s) has had the problem that such members are unnecessary when the paper is transported normally, and presence of such paper transport guide plate(s) tends to cause increase in apparatus size. Furthermore, there has also been the problem that, in the event that such transport guide plate(s) are disposed peripherally with respect to photosensitive body 81 or the like, presence of charge at photosensitive body 81 or the like will cause charging of transport guide plate(s), and suspended matter (toner, dust, etc.) flying about within the apparatus could adhere thereto and could soil the paper which is transported therethrough.

SUMMARY OF INVENTION

A paper transport apparatus in accordance with one or more embodiments of the present invention comprises photosensitive body or bodies serving as image carrier(s) carrying toner; transfer roller(s) serving as transfer means, rotating and coming in contact with such photosensitive body or bodies, for causing toner image(s) formed on the photosensitive body or bodies to be electrostatically relocated onto paper; and paper transport means disposed upstream in transport direction(s) from such transfer roller (s) and comprising drive roller(s) and idler roller(s) holding lead edge portion(s) of paper in nip(s) formed therebetween and rotating so as to cause transport of same; the paper transport apparatus being constituted such that paper transport means is or are disposed to the side, on which photosensitive body or bodies is or are present, of a plane more or less tangent to nip(s) formed between photosensitive body or bodies and transfer roller(s); and direction(s) of transport of paper from paper transport means is or are disposed so as to be directed toward transfer roller(s). In accordance with one or more embodiments of the present invention, by thus causing lead edge(s) of paper transported from paper transport means to be directed toward transfer roller(s), it is possible to avoid situations in which the lead edge of the paper hits the photosensitive body surface such that a certain angle is formed therebetween.

In addition to the foregoing constitution, in one or more embodiments of the present invention, voltage(s) opposite in polarity to electrostatic potential(s) of photosensitive body or bodies may be applied to idler roller(s). By so doing, when lead edge(s) of paper approach vicinity or vicinities of point(s) at which contact is made with photosensitive body or bodies, lead edge(s) of paper charged with opposite polarity will be electrically drawn toward photosensitive body surface(s), permitting lead edge(s) of paper to be drawn toward photosensitive body surface(s) in smooth fashion. That is, because force(s) with which lead edge(s) of paper hit photosensitive body surface(s) is or are reduced, deterioration of photosensitive body or bodies can be prevented before it occurs, increasing photosensitive body life and making it possible to achieve stable print quality.

Furthermore, in one or more embodiments of the present invention, voltage(s) may be applied to idler roller(s), with no voltage(s) being applied to drive roller(s). If voltage(s) were to be applied to drive roller(s), talc or other such paper dust present in or on paper might be deposited due to applied voltage(s) from paper as it is held in nip(s) formed between the two rollers or sets of rollers, lowering transfer efficiency or efficiencies during transfer operation(s) and tending to cause decrease in print quality. While this is also true when voltage(s) is or are applied to idler roller(s), when voltage(s) is or are applied to idler roller(s), because talc or other such paper dust is deposited at back side(s) of photosensitive roller(s), there is no lowering of transfer efficiency or tendency to cause decrease in print quality.

Furthermore, in one or more embodiments of the present invention, drive roller(s) may comprise metal roller(s), and/or idler roller(s) may comprise electrically conductive elastic roller(s). Constituting respective roller(s) in such fashion permit smooth transport of charged paper and makes it possible to eliminate situations in which paper fails to separate from and becomes wrapped around roller(s) and/or transport problems or the like arising due to electrostatic force(s). Furthermore, employment of elastic roller(s) (electrically conductive rubber, foam resin, etc.) as idler roller(s) makes it possible to ensure definitive formation of nip region(s) (region(s) at which paper is held) between drive roller(s) and idler roller(s), and permits accurate application of voltage(s) to paper.

In such case, application of voltage(s) to idler roller(s) may be timed relative to holding of lead edge portion(s) of transported paper by nip(s) formed between drive roller(s) and idler roller(s). That is, what requires a soft landing (electrical attraction) with respect to the photosensitive body is the lead edge of the paper. Accordingly, there is no need to constantly apply voltage(s) to idler roller(s). Furthermore, drive roller(s) and idler roller(s) are paused with lead edge(s) of paper held in nip(s) formed between the two rollers or sets of rollers in order to cause lead edge(s) of paper to be aligned with lead edge(s) of image(s), and because width(s) of such nip(s) (length(s) in paper transport direction(s)) is or are constant regardless of the type of paper, application of voltage(s) timed relative to holding of lead edge portion(s) by nip(s) formed therebetween permits definitive charging of lead edge portion(s) of paper.

In such case, length(s) of paper lead edge portion(s) at which voltage(s) is or are applied may be made not so long as to substantially affect information contained in image(s) formed on photosensitive body or bodies (the maximum such length ordinarily being referred to as the paper lead edge void region). Carrying out charging over region(s) wider than paper lead edge void region(s) will cause charging to encroach upon image information region(s), causing the paper to assume precharged state(s) during transfer operation(s). With the paper in such state(s), there is a tendency for unfixed toner, which will be constituted into image information, to be scattered due to precharge electric potential(s) and there is a tendency for phenomena to occur whereby toner is scattered, which can cause fogging of image(s). Length(s) of paper lead edge portion(s) at which voltage(s) is or are applied may therefore be kept within paper lead edge void region(s).

Furthermore, applied voltage(s) may be varied in accordance with difference(s) in thickness attributable to type of transported paper, being increased with increasing thickness of paper. It is a known fact that the electrostatic potential of paper will vary in accordance with the thickness of the transported paper even where the same charge is applied thereto. That is, if the same voltage is applied thereto, the electric potential at the paper surface will be greater for light-weight paper, and will be less for heavy-weight paper. Accordingly, in one or more embodiments of the present invention, paper may be charged in advance, and in order to cause soft landing(s) with respect to photosensitive body or bodies, applied voltage(s) may be varied in accordance with paper type so as to cause electric potential(s) to be the same at respective paper surfaces.

More specifically, absolute value(s) of maximum applied voltage(s) may be made less than absolute value(s) of surface potential(s) to which photosensitive body or bodies is or are charged. It is still more preferred that absolute value(s) of maximum applied voltage(s) be made approximately equal to absolute value(s) of development bias voltage(s) which when applied to transfer roller(s) would cause latent electrostatic image(s) on photosensitive body or bodies to become manifest. If applied voltage(s) is or are too high, toner in image information area(s) will be drawn to paper lead edge void area(s). Conversely, if applied voltage (s) is or are too low, paper will fail to make soft landing(s) with respect to photosensitive body or bodies and will hit same. Accordingly, it is desirable that applied voltage(s) be within the foregoing range(s).

For example, if photosensitive body surface potential is 800 V and development bias is 400 V, application of a voltage of 800 V or more to charge the paper will result in very good nip entry phenomena between paper and photosensitive body, but because the toner on the photosensitive body "sees" a greater attractive force from the paper than the electrostatic force between the toner and the photosensitive body, toner will adhere to the paper lead edge void area before the transfer region can be reached. For this reason, irregular printing and/or soiling of lead edge void area(s) will tend to occur. In order to eliminate such phenomena, it is desirable to apply voltage(s) more or less equal in magnitude to electric potential(s) which when applied to developer unit(s) would cause latent electrostatic image(s) on photosensitive body or bodies to become visible. That is, the development bias is a bias potential set so as to cause developer material to adhere or not adhere to the photosensitive body depending upon whether image information is present. In one or more embodiments of the present invention, because paper lead edge void area(s) is or are non-imaged region(s), attraction of toner thereto must be avoided, and it is moreover necessary to cause paper to experience soft landing(s) at photosensitive body or bodies. Accordingly, by causing voltage(s) applied to idler roller(s) to be more or less equal in magnitude to development bias(es), it is possible to cause soft landing(s) at photosensitive body or bodies, and it is also possible to eliminate occurrence of printing troubles before they occur.

DESCRIPTION OF PREFERRED EMBODIMENTS

Below, embodiments of the present invention are described with reference to the drawings. Description of the present embodiment is carried out in terms of a situation in which a paper feed apparatus associated with the present invention is installed in a digital copier.

Description of Overall Constitution of Copier

Figure 1:
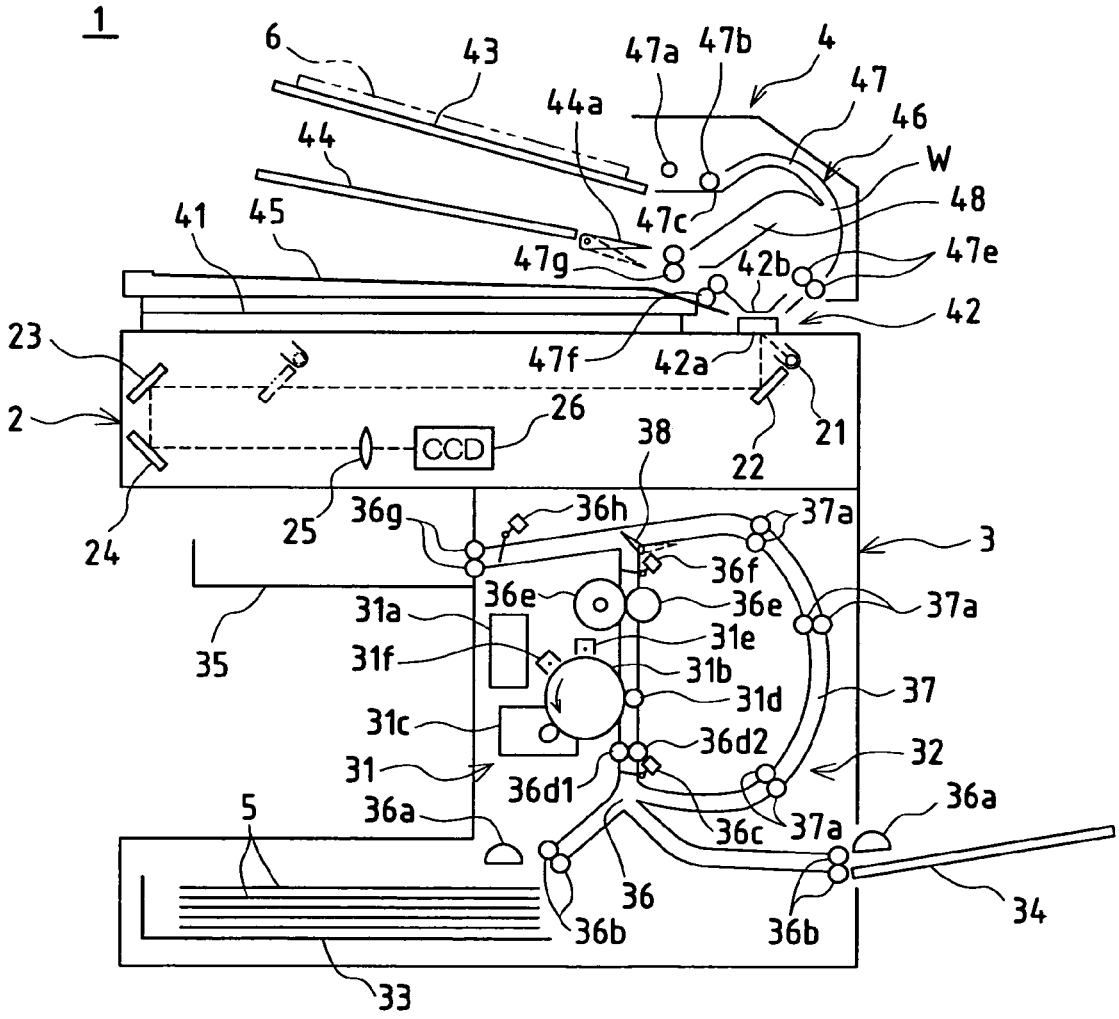
FIG. 1 is a schematic drawing showing the internal constitution of a copier associated with an embodiment of the present invention.

FIG. 1 shows in schematic fashion the internal constitution of copier 1 associated with the present embodiment. The present copier 1 is provided with scanning unit 2, printing unit 3 serving as image forming unit, and automatic original feed unit 4. Description of the respective units follows below.

Description of Scanning Unit 2

At the subassembly represented by scanning unit 2, images of originals placed on original stage 41 comprising transparent glass or the like and/or images of originals fed one at a time from automatic original feed unit 4 are captured and image data is created. This scanning unit 2 is provided with exposing light source 21; plurality of reflecting mirrors 22, 23, 24; imaging lens 25; and photoelectric conversion element (CCD=charge coupled device) 26.

The aforementioned exposing light source 21 causes light to be irradiated onto originals placed on original stage 41 of automatic original feed unit 4 and/or originals transported thereto by automatic original feed unit 4. As indicated by the optical axis depicted using a dashed line at FIG. 1, respective reflecting mirrors 22, 23, 24 cause light reflected from the original to first be reflected to the left as shown in the drawing, to thereafter be reflected downward, and to thereafter be reflected to the right as shown in the drawing so as to be directed toward imaging lens 25.

Operations for capturing the original image are such that, in the situation where the original is placed on the aforementioned original stage 41 (i.e., stationary sheet operation), exposing light source 21 and reflecting mirror 22 scan horizontally in parallel fashion with respect to original stage 41 from a position indicated by the solid line in FIG. 1 to a position indicated by the imaginary line therein so as to capture an image of the entire original. On the other hand, in the situation where the original is transported by automatic original feed unit 4 (i.e., moving sheet operation), exposing light source 21 and reflecting mirror 22 remain stationary at a position as indicated by the solid line in FIG. 1, and original capturing unit 42 of automatic original feed unit 4, described below, is made to capture an image of the original when the original passes therethrough. Moreover, this original capturing unit 42 comprises glass platen 42*a*, described below; original backpressure plate 42*b*; exposing light source 21; reflecting mirrors 22, 23, 24; imaging lens 25; and photoelectric conversion element 26.

Light reflected by the aforementioned respective reflecting mirrors 22, 23, 24 and passing through imaging lens 25 is guided to photoelectric conversion element 26, the reflected light being converted into electrical signal(s) (original image data) at this photoelectric conversion element 26.

Description of Printing Unit 3

Printing unit 3 is provided with image forming system 31 and paper transport system 32.

Image forming system 31 is provided with laser scanning unit 31*a* and drum-type photosensitive body 31*b*. Laser scanning unit 31*a* irradiates the surface of photosensitive body 31*b* with laser light based on original image data produced by conversion at the aforementioned photoelectric conversion element 26. Photosensitive body 31*b* rotates in the direction indicated by the arrow in FIG. 1, and a latent electrostatic image is formed on the surface thereof as a result of irradiation thereof by laser light from laser scanning unit 31*a*.

Furthermore, arranged in order in a circumferential direction peripheral and exterior to photosensitive body 31*b* there are—in addition to the aforementioned laser scanning unit 31*a*—developer apparatus 31*c*, transfer roller 31*d*, a cleaning apparatus (not shown), charge-removing unit 31*e*, and main charging unit 31*f*. Developer apparatus 31*c* uses toner to develop the latent electrostatic image formed on the surface of photosensitive body 31*b* and produce a visible image. Transfer roller 31*d* transfers the toner image formed on the surface of photosensitive body 31*b* onto paper 5 for image formation, which serves as recording medium. The cleaning apparatus removes toner residue from the surface of photosensitive body 31*b* following toner transfer. Charge-removing unit 31*e* removes any charge remaining on the surface of photosensitive body 31*b*. Main charging unit 31*f* charges the surface of photosensitive body 31*b* to a prescribed electric potential prior to formation of the latent electrostatic image.

When forming an image on paper 5, therefore, main charging unit 31*f* causes the surface of photosensitive body 31*b* to be charged to a prescribed electric potential, and laser scanning unit 31*a* irradiates the surface of photosensitive body 31*b* with laser light based on original image data. Developer apparatus 31*c* then develops a visible toner image on the surface of photosensitive body 31*b*, and transfer roller 31*d* causes the toner image to be transferred to paper 5. In addition, the cleaning apparatus then removes toner residue from the surface of photosensitive body 31*b*, and charge-removing unit 31*e* removes any charge remaining on the surface of photosensitive body 31*b*. This concludes one cycle of image forming operations (printing operations) which are carried out on paper 5. By repeating this cycle, it is possible to continuously carry out image formation on a plurality of sheets of paper 5, 5, . . . .

Furthermore, paper transport system 32 transports paper 5, 5, . . . for image formation one sheet at a time from where it is stored in paper cassette 33 and/or paper tray 34 serving as paper storage unit(s) so as to permit image formation by the aforementioned image forming system 31, and also discharges paper 5 for image formation to discharge tray 35 serving as paper discharge unit after image(s) have been formed thereon.

This paper transport system 32 is provided with main transport path 36 and flipping transport path 37. One end of main transport path 36 opposes discharge tray 35, and the other end thereof branches into two subpaths, the two subpaths respectively opposing the discharge sides of paper cassette 33 and paper tray 34. One end of flipping transport path 37 is connected to main transport path 36 at a point downstream from (above, in the drawing) the location at which transfer roller 31*d* is installed, and the other end thereof is connected to main transport path 36 at a point upstream from (below, in the drawing) the location at which transfer roller 31*d* is installed.

Arranged at the upstream end of main transport path 36 (at regions opposing the discharge sides of paper cassette 33 and paper tray 34) are pickup rollers 36*a* having semicircular cross-sections. Arranged immediately downstream of this pickup roller 36*a* are supply rollers 36*b*. Rotation of these pickup rollers 36*a* and supply rollers 36*b* permits paper 5, 5, . . . to be supplied in intermittent fashion, one sheet at a time, from where it is stored in paper cassette 33 and/or paper tray 34 to main transport path 36.

Respectively installed upstream from the location in this main transport path 36 at which transfer roller 31*d* is installed are registration detection switch 36*c* for detecting passage therethrough of paper 5, and drive roller 36*d*1 and idler roller 36*d*2 serving as registration rollers (PS rollers). This drive roller 36*d*1 and this idler roller 36*d*2 transport paper 5 while aligning paper 5 with the toner image on the surface of photosensitive body 31*b*. Respectively installed at points downstream from the location at which transfer roller 31*d* is installed in this main transport path 36 is a pair of fuser rollers 36*e* for heating so as to fuse the toner image transferred onto paper 5, and fusing detection switch 36*f* for detecting whether paper 5 has passed through fuser rollers 36*e*. Respectively installed at the downstream end of main transport path 36 is a pair of discharge rollers 36*g* for discharging paper 5 into discharge tray 35, and discharge detection switch 36*h* for detecting whether paper 5 has been discharged.

Arranged at a location at the top end of flipping transport path 37, where flipping transport path 37 joins main transport path 36, is diverter paddle 38. This diverter paddle 38 is capable of being rotated about a horizontal axis from a first position indicated by the solid line in FIG. 1 to a second position indicated by the imaginary line therein. When this diverter paddle 38 is in its first position, paper 5 is discharged to discharge tray 35; and when it is in its second position, paper 5 is supplied to flipping transport path 37. Transport rollers 37*a*, . . . are arranged at a plurality of locations in flipping transport path 37; and when paper 5 is supplied to flipping transport path 37, paper 5 is transported by these transport rollers 37*a*, . . . , paper 5 being flipped at a location upstream of drive roller 36*d*1 and idler roller 36*d*2, and being again transported along main transport path 36 toward transfer roller 31*d*. That is, arrangements are made to permit image formation to be carried out on the back of paper 5.

Description of Automatic Original Feed Unit 4

Automatic original feed unit 4 will next be described. This automatic original feed unit 4 is constructed so as to permit it to serve as "automatic double-sided original transport apparatus." This automatic original feed unit 4 is capable of being used for moving sheet operation, and is provided with original loading unit(s) comprising original tray 43 and intermediate tray 44 and original discharge tray 45 serving as original discharge unit, and original transport system 46 for transporting originals between respective trays 43, 44, 45.

The aforementioned original transport system 46 is provided with main transport path 47 for transporting originals 6, . . . which have been placed in original tray 43 to intermediate tray 44 and/or original discharge tray 45 by way of original capturing unit 42; and auxiliary transport path 48 for supplying originals 6 to main transport path 47 from intermediate tray 44.

Arranged at the upstream end of main transport path 47 (at a region opposing the discharge side of original tray 43) are original pickup roller 47*a* and separation roller 47*b*. Arranged below this separation roller 47*b* is separation plate 47*c*, and in accompaniment to rotation of pickup roller 47*a*, one sheet from among the originals 6, . . . in original tray 43 is made to pass between this separation roller 47*b* and this separation plate 47*c*, and is supplied to main transport path 47. Arranged at the intersection (area W in the drawing) of main transport path 47 and auxiliary transport path 48 is an original insertion sensor (not shown) for detecting passage of original 6. Moreover, arranged at a point downstream of the location at which this original insertion sensor is installed are PS rollers 47*e*. These PS rollers 47*e* supply originals 6 to original capturing unit 42 such that the leading edge of the original 6 is coordinated with the timing with which image capture occurs at scanning unit 2. That is, upon supply of an original 6 thereto, these PS rollers 47*e* temporarily stop transport of the original 6 so as to permit adjustment of the aforementioned timing before supplying the original 6 to original capturing unit 42.

Original capturing unit 42 is provided with glass platen 42*a* and original backpressure plate 42*b*, and when an original 6 supplied thereto by PS rollers 47*e* passes between glass platen 42*a* and original backpressure plate 42*b*, light from the aforementioned exposing light source 21 passes through glass platen 42*a* and irradiates the original 6. At this time, acquisition of original image data by the aforementioned scanning unit 2 occurs.

Provided downstream of original capturing unit 42 are transport rollers 47*f* and original discharge rollers 47*g*. The constitution is such that upon passing through original capturing unit 42, originals 6 are discharged to intermediate tray 44 and/or original discharge tray 45 by way of transport rollers 47*f* and original discharge rollers 47*g*.

Arranged between original discharge rollers 47*g* and intermediate tray 44 is intermediate tray pivot plate 44*a*. The pivoting motion of this intermediate tray pivot plate 44*a* being centered on the end thereof which is nearer to intermediate tray 44, intermediate tray pivot plate 44*a* is capable of pivoting between a first position indicated by the solid line in FIG. 1 and a second position indicated by the imaginary line therein. When intermediate tray pivot plate 44*a* is in its first position, originals 6 discharged by original discharge rollers 47*g* are recovered into original discharge tray 45. On the other hand, when intermediate tray pivot plate 44*a* is in its second position, originals 6 discharged by original discharge rollers 47*g* are discharged into intermediate tray 44. When an original 6 is discharged to this intermediate tray 44, the edge of the original 6 is held in the nip between original discharge rollers 47*g*; and with the original 6 in this state, original discharge rollers 47*g* then rotate backwards, causing the original 6 to be supplied to auxiliary transport path 48, and after traveling through this auxiliary transport path 48, the original is again delivered to main transport path 47. Operations whereby these original discharge rollers 47*g* are made to rotate backwards are carried out such that delivery of the original 6 to main transport path 47 is coordinated with the timing with which image capture occurs. This make it possible for original capturing unit 42 to capture an image of the back of the original 6.

The foregoing is an overall description of the internal constitution of copier 1 associated with the present embodiment.

Next, referring to FIGS. 2 through 6, paper transport direction and structural arrangement of photosensitive body 31*d* as well as drive roller 36*d*1 and idler roller 36*d*2, these being characteristic of the present embodiment, are described.

Figure 2:
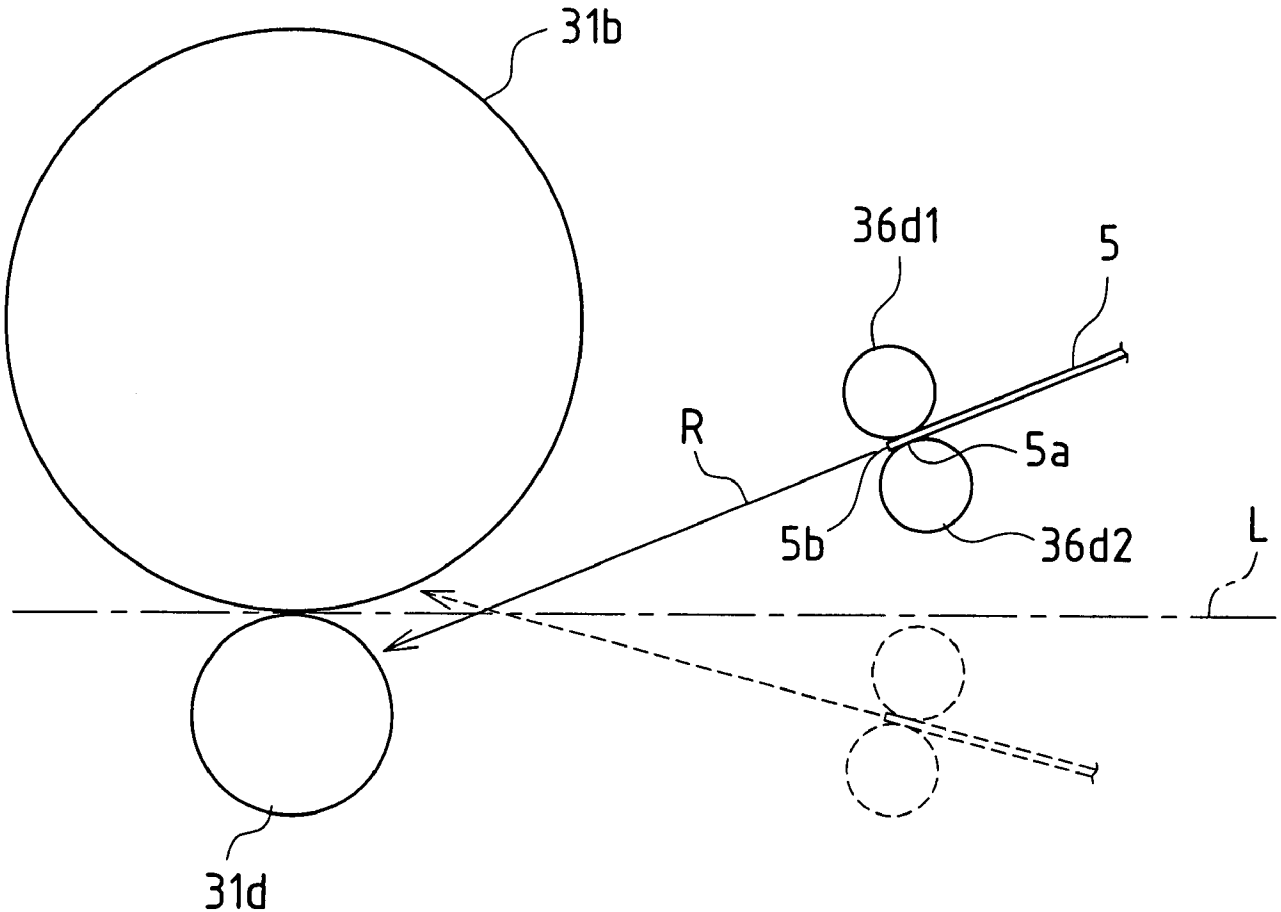
FIG. 2 is a schematic drawing showing structural arrangement of a photosensitive body as well as a drive roller and an idler roller.

As shown in FIG. 2, a first characteristic of the present embodiment is that drive roller 36*d*1 and idler roller 36*d*2 are disposed to the side, on which photosensitive body 31*b* is present, of a plane L more or less tangent to the nip formed between photosensitive body 31*b* and transfer roller 31*d*; and the trajectory R of the paper as it is transported from drive roller 36*d*1 and idler roller 36*d*2 being directed toward so as to be directed toward transfer roller 31*d*, which is below tangent plane L. That is, as viewed with reference to tangent plane L, structural arrangement in the present embodiment is such that drive roller 36*d*1 and idler roller 36*d*2 are disposed at locations quite opposite to the locations (indicated by dashed line in FIG. 2) at which they were conventionally disposed; and moreover, paper transport direction R is likewise disposed not in the direction (indicated by dashed line in FIG. 2) of photosensitive body 31*b* as was the case conventionally but in the direction of transfer roller 31*d*.

Figure 3:
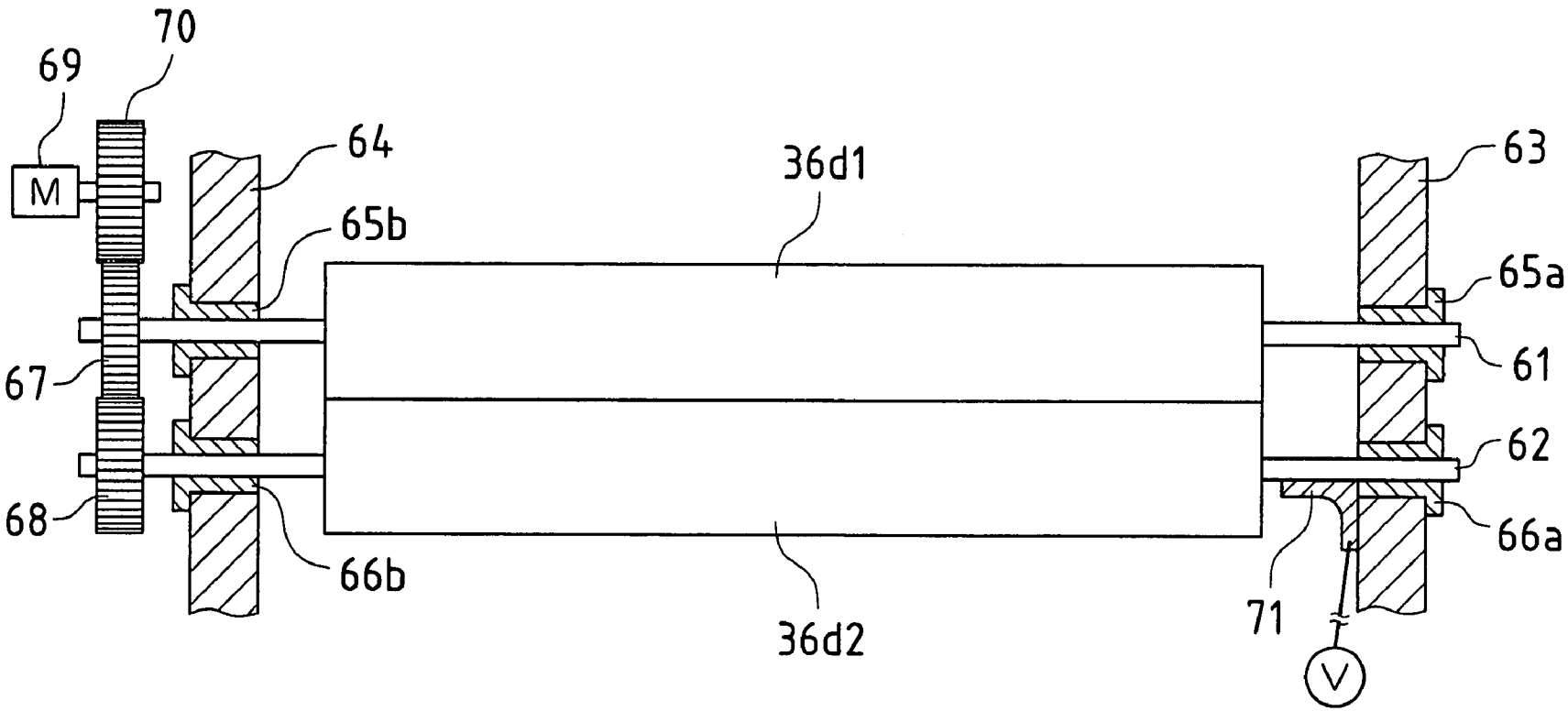
FIG. 3 is a schematic drawing showing a support structure for a drive roller and an idler roller.

As shown in FIG. 3, in the context of such structural arrangement, a second characteristic of the present embodiment is, furthermore, that voltage application electrode plate 71 is attached to shaft 62 which causes rotation of idler roller 36*d*2, a constitution being adopted such as will permit application of voltage to idler roller 36*d*2 with prescribed timing as will be described below.

Figure 4:
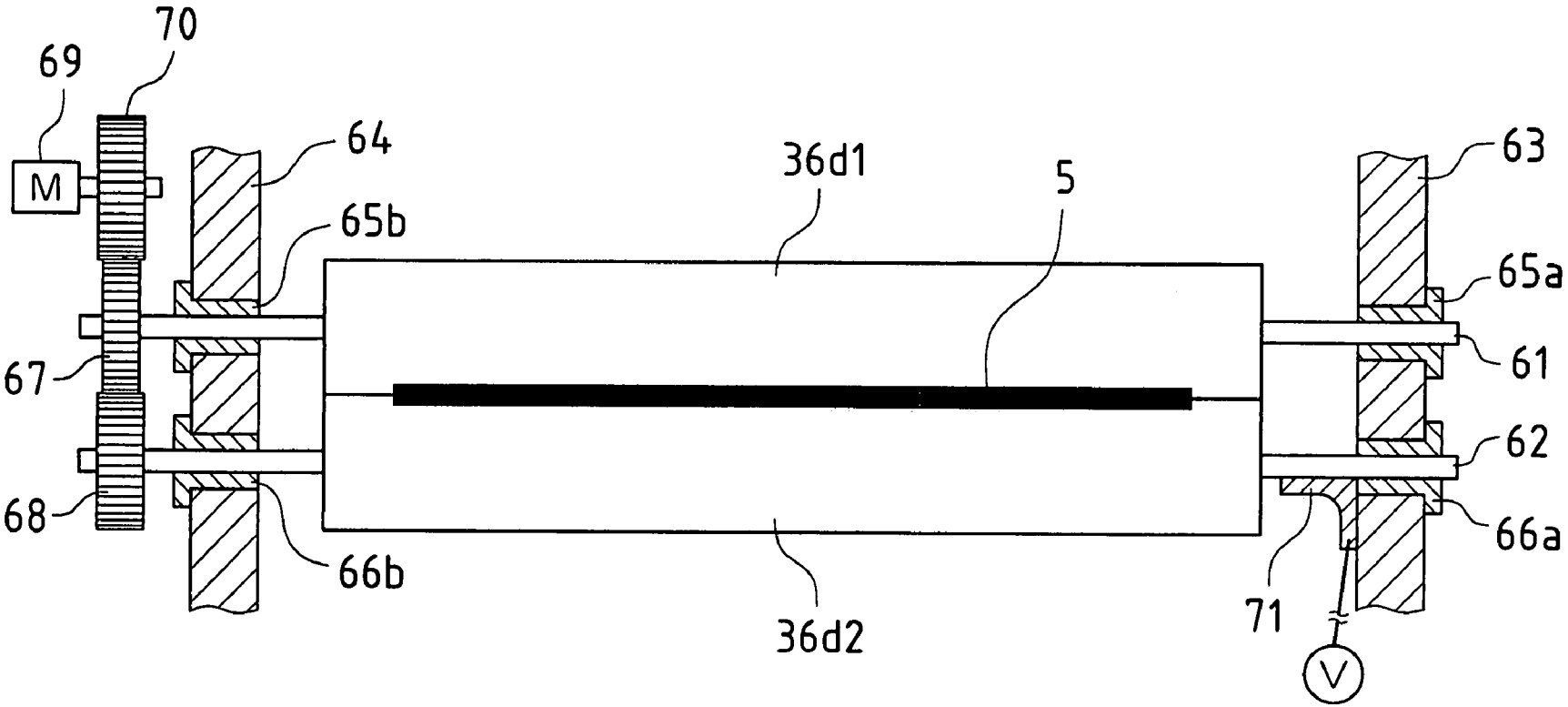
FIG. 4 is a schematic drawing showing a support structure for a drive roller and an idler roller.

FIGS. 3 and 4 show the structure (support structure) of drive roller 36*d*1 and idler roller 36*d*2.

Drive roller 36*d*1 and idler roller 36*d*2 are integrally supported by respective shafts 61, 62 arranged in parallel and adjacent fashion, the structure being such that these shafts 61, 62 are inserted into and rotatably supported by pairs of bearings 65*a*, 65*b* and 66*a*, 66*b* respectively provided at apparatus frame members 63, 64 arranged at either side of shafts 61, 62. In addition, gears 67, 68, which are mutually meshingly engaged and rotate, are rigidly mated in integral fashion to the respective end regions of shafts 61, 62 protruding from bearings 65*b*, 66*b* provided at one of the apparatus frame members 64; and gear 70, which is attached to drive motor 69, meshingly engages with gear 67, which is mated to shaft 61 of drive roller 36*d*1. As a result, when drive motor 69 rotates in one direction, drive roller 36*d*1 and idler roller 36*d*2 rotate in mutually opposite directions, causing any paper in the nip formed between these two rollers 36*d*1, 36*d*2 to be transported in one direction.

In the foregoing constitution, voltage application electrode plate 71 is formed in angle bracket fashion, one leg 71*b* thereof being secured to a wall surface of apparatus frame member 63 by means of screw(s), bolt(s), or the like, not shown, such that the other leg 71*a* thereof is made to contact shaft 62 of idler roller 36*d*2.

Furthermore, idler roller 36*d*2, including shaft 62 associated therewith, is entirely made up of an electrically conductive elastic roller. As a result, a voltage applied to voltage application electrode plate 71 will be applied to the surface of idler roller 36*d*2. Furthermore, drive roller 36*d*1 is made up of a metal roller.

Furthermore, apparatus frame members 63, 64 and respective bearings 65*a*, 65*b*, 66*a*, 66*b* are formed from insulating material(s). The reason for forming apparatus frame members 63, 64 and bearings 65*a*, 65*b*, 66*a*, 66*b* from insulating material(s) in this fashion is to prevent the applied voltage from causing electric shock to the user and/or harmful effects to other components by way of bearings 65*a*, 65*b*, 66*a*, 66*b* and apparatus frame members 63, 64, since, as shown in FIG. 4, the size of paper 5 which passes therethrough is not always the same (being of many types; e.g., A4, B4, postcard, etc.).

Figure 5:
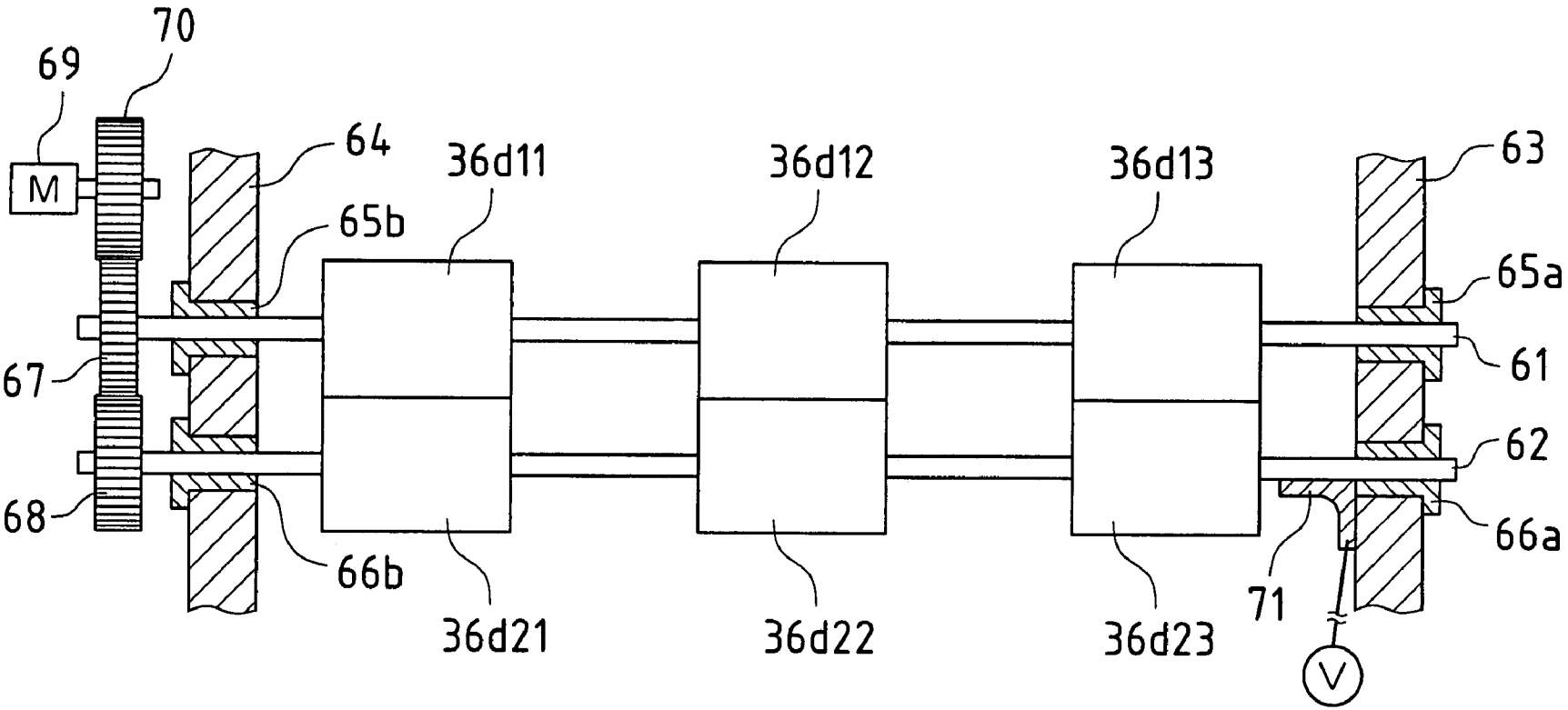
FIG. 5 is a schematic drawing showing another support structure for a drive roller and an idler roller.

Note that whereas in the present embodiment drive roller 36*d*1 and idler roller 36*d*2 are each made up of a single roller and a single shaft, similar effect may also be achieved by, as shown in FIG. 5, dividing each roller portion into a plurality (three in the present example) of segments, the set of drive roller segments 36*d*11, 36*d*12, 36*d*13 and the set of idler roller segments **36*d*21, 36*d*22, 36*d*23 each being arranged at prescribed intervals along a single shaft 61, 62**.

The relationship between surface potential as a function of paper type versus voltage applied to idler roller **36*d*2** constituted in such fashion is shown in TABLE 1. Note that the types of paper presented by way of example in TABLE 1 are types of paper manufactured within Japan.

TABLE 1

RELATIONSHIP BETWEEN APPLIED VOLTAGE AND PAPER TYPE

| Paper Type (Japanese Paper) | Light-Weight Paper | Plain Paper | Card Stock 1 (Postcard) | Card Stock 2 (Coated; For Use as Cover) |
|---|---|---|---|---|
| Paper Thickness (μ) | 50 | 80 | 100 | 195 |
| Voltage Applied to Idler Roller (V) | 390 | 400 | 420 | 450 |
| Surface Potential at Paper (V) | 380 | 380 | 380 | 380 |

Paper thickness, paper weight determining external forces applied thereto during paper feed, is roughly from 50μ to 200μ.

Upon application of voltage to such papers, whereas light-weight paper exhibits a surface potential which is more or less equal to the applied voltage, heavy-weight paper exhibits a surface potential which is only approximately 85% to 95% of the applied voltage. The reason for this is the thickness and resistance of the paper, measured data being as shown in TABLE 1, above. Note that when the type of paper used is OHP media, values conform to those given for Card Stock 2 at TABLE 1.

Next, feeding Plain Paper obtained as a result of the foregoing testing through the paper transport apparatus of the present embodiment, the voltage applied at idler roller **36*d*2 was varied in order to study print quality as well as nip entry characteristics between paper 5 and photosensitive body 31*b***. Results are shown in TABLE 2.

TABLE 2

RELATIONSHIP BETWEEN APPLIED VOLTAGE AND PRINT QUALITY AS WELL AS NIP ENTRY CHARACTERISTICS (PLAIN PAPER)

| Surface Potential at Paper (V) | 300 | 350 | 380 | 420 | 500 | 700 | 800 | 900 |
|---|---|---|---|---|---|---|---|---|
| Voltage Applied to Idler Roller (V) | 310 | 360 | 390 | 430 | 505 | 705 | 800 | 900 |
| Rating | | | | | | | | |
| Soiling at Lead Edge Void | VG | VG | VG | G | OK | OK | NG | NG |
| Irregular Printing | VG | VG | VG | VG | OK | G | NG | NG |
| Paper Nip Entry Characteristics | NG | OK | G | G | VG | VG | VG | VG |
| Electrostatic Deterioration of Photosensitive Body | VG | VG | VG | G | OK | NG | NG | NG |

(Symbols used in table:
VG = very good;
G = good;
OK = okay;
NG = bad)

Based on TABLE 2, application of a voltage of between 310 V and 900 V to idler roller **36*d*2** resulted in a surface potential at the paper of between 300 V and 900 V due to application thereof.

Here, by carrying out application of voltage to paper 5 while in a paused state with the lead edge portion (hereinafter, "lead edge void area") **5*a* of paper 5 chucked between drive roller 36*d*1 and idler roller 36*d*2, application of voltage is carried out only with respect to lead edge void area 5*a* of paper 5. The main reason for carrying out of application of voltage only with respect to lead edge void area 5*a* is that, since there is no image information at lead edge void area 5*a*, irregular printing of image information should not occur so long as the proper electric potential is applied. Furthermore, another reason which may also be cited is that so long as lead edge void area 5*a* is caused to be drawn toward photosensitive body 31*b* as paper 5 is transported thereto, the surface of photosensitive body 31*b*** will not be scratched thereby and paper transport thereafter will proceed smoothly.

In this regard, it has been learned that, during application of the voltage to lead edge void area **5*a* of paper 5, while a high surface potential will result in improved nip entry characteristics for paper 5, it will also cause occurrence of soiling at lead edge void area 5*a*** and/or irregular printing at the image information lead edge area.

That is, voltage is applied in order to cause paper 5 to be drawn toward photosensitive body **31*b*, but if the surface potential at lead edge void area 5*a* of paper 5 is too high, this will cause unfused toner on photosensitive body 31*b* to be electrostatically attracted to lead edge void area 5*a* of paper 5, which will tend to cause soiling at lead edge void area 5*a*** and/or irregular printing of image information.

Based on the present study, the surface potential at the paper lead edge area appears to exhibit a behavior similar to that occurring between toner and photosensitive body **31*b* during the operation in which the image is made manifest (development operation), satisfactory results being obtained with respect to all criteria for voltages more or less equal in magnitude to the development bias. It is thought that whether soiling at the lead edge void area and/or irregular printing of image information occurs is determined by the characteristics of the toner adhering to photosensitive body 31*b*; i.e., whether it is attracted by the electrostatic force from photosensitive body 31*b* (in which case print quality is not disturbed) or whether it is attracted by the surface potential of lead edge void area 5*a* of paper 5** (in which case print quality is disturbed).

Furthermore, photosensitive body **31*b* is typically charged (−), giving it characteristics making it especially susceptible to damage of (+) polarity; having once suffered a charge of (+) polarity it does not easily recover its (−) polarity. As shown at TABLE 2, it was learned that the surface potential of opposite polarity which would not affect photosensitive body 31***b* is not more than roughly one-half of the surface potential which is applied to photosensitive body 31*b*.

The voltage which should be applied to paper 5 during transport thereof is determined based on the foregoing study results.

Figure 6:
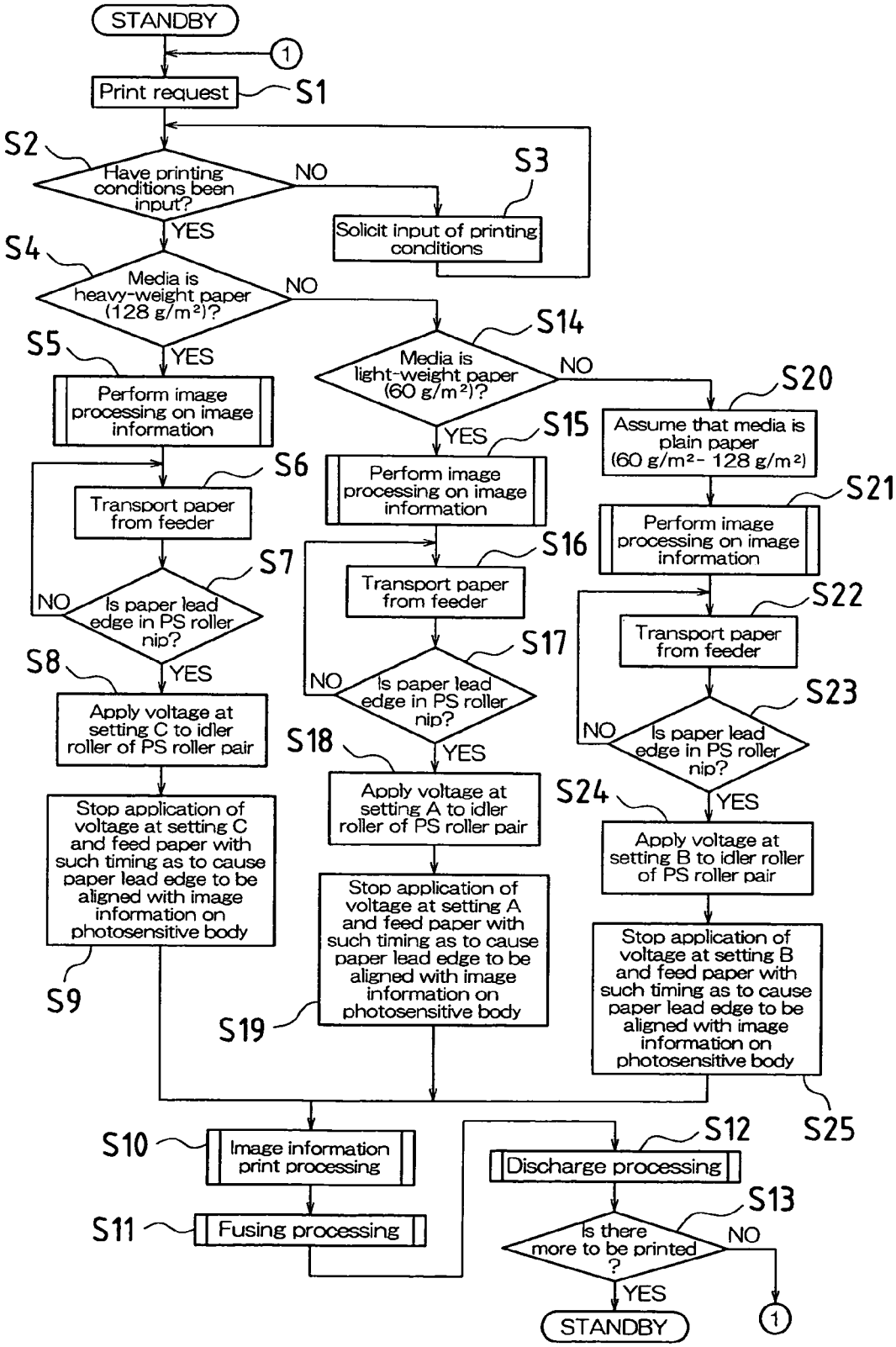
FIG. 6 is a flowchart for describing processing operations taking place when carrying out image formation with application of voltage(s), timed in prescribed fashion, using a paper transport apparatus in accordance with the present invention.
Figure 7:
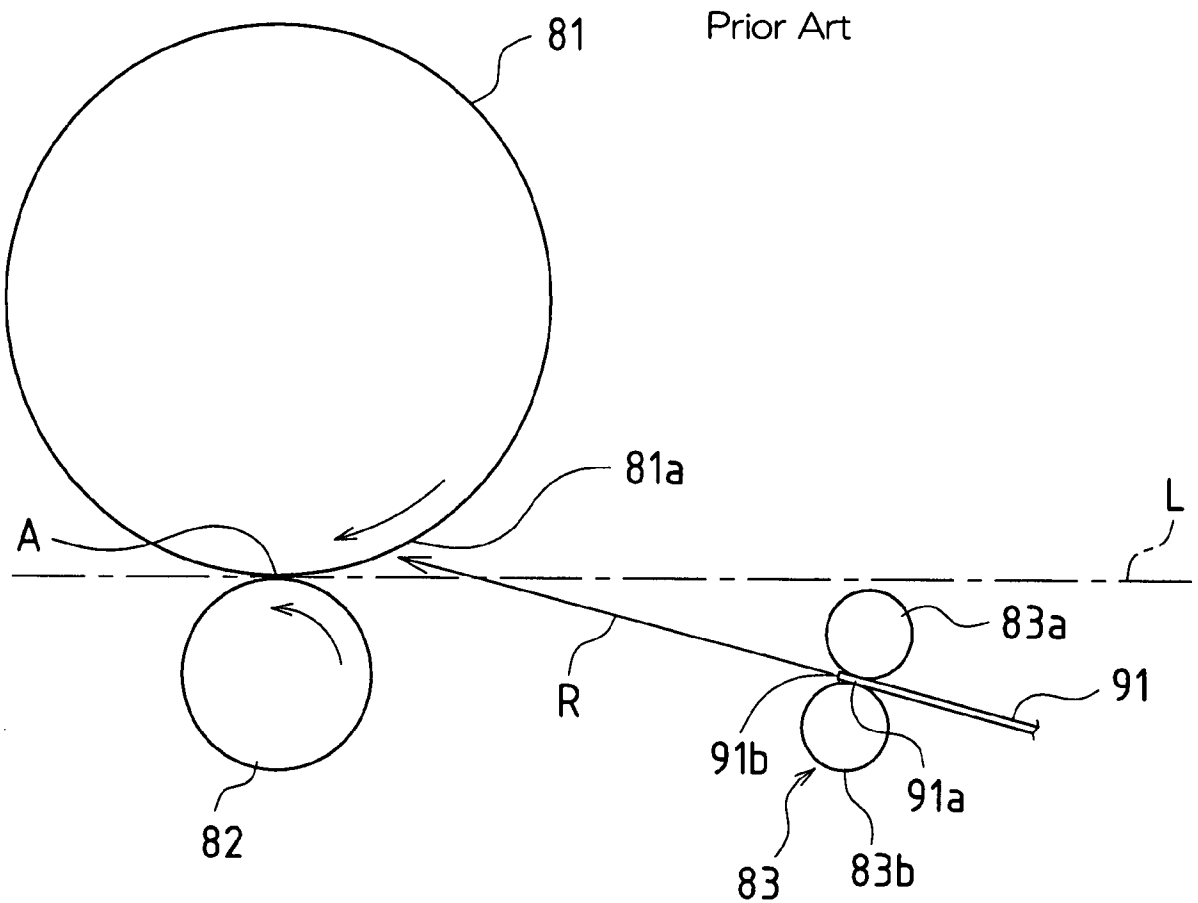
FIG. 7 is a schematic diagram showing the structure of a paper feed mechanism in a conventional image forming apparatus.
Figure 8A:
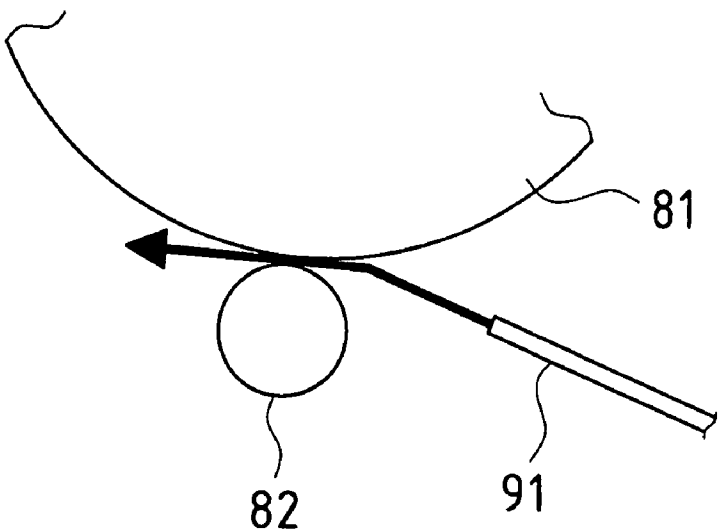
FIG.8(a) Prior Art
FIG. 8 contains illustrative drawings showing movement of paper at the point of contact with a photosensitive body.
Figure 8B:
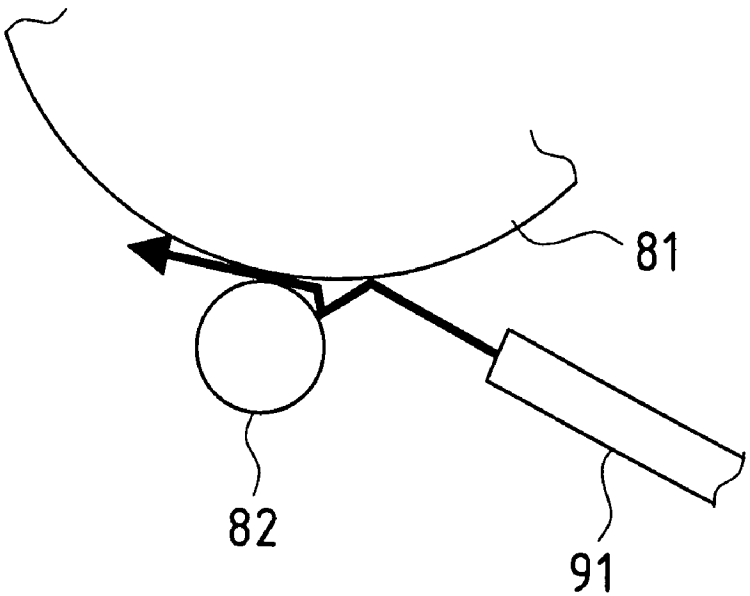
FIG.8(b) Prior Art

Next, referring to the flowchart in FIG. 6, description is carried out with respect to processing operations taking place when carrying out image formation with voltage(s) determined in such fashion being applied, application thereof being timed in prescribed fashion.

Upon receiving a print request (step S1), copier 1 solicits input of printing conditions from the user (step S2, step S3). In addition, when input of printing conditions has been completed, those conditions thereamong which indicate paper to be used for printing (light-weight paper, plain paper, heavy-weight paper, etc.) are selected (step S4, step S14, step S20). At such time, in the event that paper selection conditions have not been input, reflective sensor(s) (not shown in FIG. 1) or the like arranged at location(s) in the space from paper cassette 33 serving as paper storage unit to drive roller 36*d*1 and idler roller 36*d*2 might, if installed, permit detection of paper thickness and might permit selection of paper thickness.

During printing using paper selected in such fashion, the equipment carries out processing of image information contained in the original (step S5, step S15, step S21). This processing of image information may be processing of information contained in image(s) captured by scanning unit 2 of the equipment and/or may be print image processing of information contained in image(s) sent thereto from respective terminal device(s) present on network(s) to which the equipment is connected. Upon completion of this image processing, selected paper 5 from paper tray 34 and/or paper cassette 33 of the equipment travels along main transport path 36 and is transported to drive roller 36*d*1 and idler roller 36*d*2 serving as PS roller unit(s) (step S6, step S16, step S22).

In addition, when lead edge void area 5*a* of paper 5 is held in the nip formed between drive roller 36*d*1 and idler roller 36*d*2 (step S7, step S17, step S23), drive roller 36*d*1 and idler roller 36*d*2 temporarily stop, paper feed resuming with such timing as to cause lead edge 5*b* of paper 5 to be aligned with the lead edge of the image information on photosensitive body 31*b*.

In accordance with the present invention, application of voltage to idler roller 36*d*2 is carried out during this period when paper feed is stopped. The voltage which is applied at this time has been previously stored in controller memory at the equipment based on the data indicated in TABLE 1, above, the voltage which is applied being varied depending upon the type of paper which is fed therethrough. That is, lead edge void area 5*a* of paper 5 is charged as a result of application of voltage at setting A (390 V at TABLE 1) in the event that light-weight paper is fed therethrough as indicated at step S18; or as a result of application of voltage at setting B (400 V at TABLE 1) in the event that plain paper is fed therethrough as indicated at step S24; or as a result of application of voltage at setting C (420 V for Card Stock 1, or 450 V for Card Stock 2, at TABLE 1) in the event that heavy-weight paper is fed therethrough as indicated at step S8. After lead edge void area 5*a* thereof has been charged in such fashion, paper 5 is transported (step S9, step S19, step S25) with such timing as has been described above, and is guided to the transfer unit where photosensitive body 31*b*, transfer roller 31*d*, and/or the like are installed; and the transfer operation is carried out (step S10). Unfused toner transferred to paper 5 is fixed to paper 5 as a result of passage of same through fuser rollers 36*e*, 36*e* (step S11), and paper 5 is discharged to discharge tray 35 which is arranged at the exterior of the equipment (step S12).

As has been described above, the present invention permits mitigation of the force of impact of lead edge 5*b* of paper 5 with respect to photosensitive body 31*b*, permits improvement in print quality, and permits attainment of increased life of photosensitive body 31*b*.

The present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are moreover within the scope of the present invention.

Moreover, the present application claims right of benefit of prior filing date of Japanese Patent Application No. 2002-355506, the content of which is incorporated herein by reference in its entirety. Furthermore, all references cited in the present specification are specifically incorporated herein by reference in their entirety.

What is claimed is:

1. A paper transport apparatus comprising:

one or more image carrier or carriers carrying toner;

one or more transfer means, each transfer means having a surface that rotates and comes in contact with one of the image carrier or carriers at an upstream end of a first nip or nips, for causing one or more toner image or images formed on at least one of the image carrier or carriers to be electrostatically relocated onto one or more sheet or sheets of paper passing through said first nip or nips; and one or more paper transport means disposed upstream in one or more transport directions relative to at least one of the first nip or nips and comprising one or more pair or pairs of pressure rollers holding one or more lead edge portion or portions of at least one of the sheet or sheets of paper in one or more second nip or nips formed therebetween and rotating so as to cause transport of same; wherein at least one of the paper transport means is disposed to the side, on which at least one of the image carrier or carriers is present, of a plane more or less tangent to at least one of the first nip or nips formed between at least one of the image carrier or carriers and at least one of the transfer means;

one or more lead edge portion or portions of the at least one sheet or sheets of paper is or are transported from at least one of the paper transport means, with one or more lead edge portion or portions of said sheet or sheets of paper being oriented along a trajectory toward at least one of the transfer means which is located on the opposite side of the plane therefrom, and at least one of the pressure roller pair or pairs comprises one or more drive roller or rollers and one or more idler roller or rollers;

at least one of the chive roller or rollers comprises at least one metal roller; and at least one of the idler roller or rollers comprises at least one electrically conductive elastic roller.

2. A paper transport apparatus according to claim 1 wherein:

at least one of the idler roller or rollers of at least one of the pressure roller pair or pairs is driven by at least one of the drive roller or rollers.

3. A paper transport apparatus according to claim 1 wherein:

one or more voltage or voltages opposite in polarity to at least one electrostatic potential or potentials of at least one of the image carrier or carriers is or are applied to at least one of the idler roller or rollers of at least one of the pressure roller pair or pairs.

4. A paper transport apparatus according to claim 3 wherein:

at least one of the applied voltage or voltages is varied in accordance with a difference or differences in thickness attributable to a type transported paper.

5. A paper transport apparatus according to claim 4 wherein:

at least one of the applied voltage or voltages increases with increasing paper thickness.

6. A paper transport apparatus according to claim 4 wherein:

at least one absolute value of at least one maximum applied voltage is less than at least one absolute value of at least one surface potential to which at least one of the image carrier or carriers is charged.

7. A paper transport apparatus according to claim 5 wherein:

at least one absolute value of at least one maximum applied voltage is less than at least one absolute value of at least one surface potential to which at least one of the image carrier or carriers is charged.

8. A paper transport apparatus according to any of claims 1, 2 or 3 wherein:

an application of a voltage or voltages to at least one of the idler roller or rollers is or are timed relative to the holding of at least one of the lead edge portion or portions of at least one of the transported sheet or sheets of paper by at least one of the second nip or nips formed by at least one of the pressure roller pair or pairs.

9. A paper transport apparatus according to claim 8 wherein:

at least one length or lengths of at least one of the paper lead edge portion or portions at which said voltage or voltages is or are applied is not so long as to substantially affect information contained in at least one image or images formed on at least one of the image carrier or carriers.

10. A paper transport apparatus according to claim 9 wherein:

at least one of the applied voltage or voltages is varied in accordance with a difference or differences in thickness attributable to a type or types of transported paper.

11. A paper transport apparatus according to claim 10 wherein:

at least one of the applied voltage or voltages increases with increasing paper thickness.

12. A paper transport apparatus according to claim 10 wherein:

at least one absolute value of at least one maximum applied voltage is less than at least one absolute value of at least one surface potential to which at least one of the image carrier or carriers is charged.

13. A paper transport apparatus according to claim 8 wherein:

at least one of the applied voltage or voltages is varied in accordance with a difference or differences in thickness attributable to a type or types of transported paper.

14. A paper transport apparatus according to claim 13 wherein:

at least one of the applied voltage or voltages increases with increasing paper thickness.

15. A paper transport apparatus according to claim 14 wherein:

at least one absolute value of at least one maximum applied voltage is less than at least one absolute value of at least one surface potential to which at least one of the image carrier or carriers is charged.

16. A paper transport apparatus according to claim 15 wherein:

at least one absolute value of at least one maximum applied voltage is approximately equal to at least one absolute value of at least one development bias voltage which when applied to at least one of the transfer means would cause at least one latent electrostatic image or images on at least one of the image carrier or carriers to become manifest.

17. A paper transport apparatus according to claim 13 wherein:

at least one absolute value of at least one maximum applied voltage is less than at least one absolute value of at least one surface potential to which at least one of the image carrier or carriers is charged.

18. A paper transport apparatus according to claim 1 wherein:

at least one absolute value of at least one maximum applied voltage is less than at least one absolute value of at least one surface potential to which at least one of the image carrier or carriers is charged.

19. A paper transport method for transporting one or more sheets of paper relative to one or more image forming means comprising one or more image carrier or carriers carrying toner and one or more transfer roll or rollers, each including a surface rotating and coming in contact with at least one of the image carrier or carriers at a first nip or nips for causing one or more toner image or images formed on at least one of the image carrier or carriers to be electrostatically relocated onto one or more sheets of paper; said paper transport method including the steps of:

(i) providing one or more paper transport means disposed (a) upstream from an upstream end or ends of said first nip or nips in one or more transport direction or directions relative to at least one of the transfer means and (b) to the side, on which at least one of the image carrier or carriers is or are present, of a plane more or less tangent to the at least one first nip or nips formed between at least one of said image carrier or carriers and the surface of at least one of said transfer roller or rollers, said one or more paper transport means comprising one or more pair or pairs of oppositely rotating pressure rollers holding one or more leading edge portion or portions of at least one of said sheet or sheets of paper in one or more second nip or nips formed therebetween, wherein at least one of the pressure roller pair or pairs comprises one or more drive roller or rollers and one or more idler roller or rollers, at least one of the drive roller or rollers comprises at least one metal roller; and at least one of the idler roller or rollers comprises at least one electrically conductive elastic roller; and (ii) transporting said leading edge portion or portions of said at least one sheet or sheets of paper from said at least one second nip or nips of the paper transport means with the one or more sheet or sheets of paper being oriented along a trajectory toward at least one of said transfer means which is located on the opposite side of said plane therefrom.

20. A paper transport method according to claim 19, wherein:

one or more voltage or voltages, that is or are timed in a prescribed fashion and opposite in polarity to at least one electrostatic potential or potentials applied to at least one of the image carrier or carriers, is or are applied to one or more of said pressure roller or rollers of said one or more paper transport means such that said one or more voltage or voltages is or are applied to only lead edge portion or portions of at least one of said sheet or sheets of paper transported to at least one of said image forming means.

21. A paper transport method according to claim 20 wherein:

at least one length or lengths of at least one of the paper lead edge portion or portions at which voltage or voltages is or are applied is not so long as to substantially affect information contained in at least one image or images formed on at least one of the image carrier or carriers.

22. A paper transport method according to claim 21 wherein:

at least one of the applied voltage or voltages is varied in accordance with a difference or differences in thickness attributable to a type or types of transported paper, being increased with increasing thickness or thicknesses of the paper.

23. A paper transport method according to any of claims 19 through 21 wherein:

at least one absolute value of at least one maximum applied voltage is less than at least one absolute value of at least one surface potential to which at least one of the image carrier or carriers is charged.

24. A paper transport method according to claim 23 wherein:

at least one absolute value of at least one maximum applied voltage is approximately equal to at least one absolute value of at least one development bias voltage which when applied to at least one of the transfer means would cause at least one latent electrostatic image or images on at least one of the image carrier or carriers to become manifest.

* * * * *